US005636810A

United States Patent [19]

Dörfel et al.

[11] Patent Number: 5,636,810

[45] Date of Patent: Jun. 10, 1997

[54] APPARATUS FOR APPLYING ADHESIVE TO A WEB ROLL BEING WOUND IN A WINDING MACHINE

[75] Inventors: Gerhard W. Dörfel, Boll; Michael Taxis, Diezisau, both of Germany

[73] Assignee: Beloit Technologies, Inc., Wilmington, Del.

[21] Appl. No.: 356,399

[22] PCT Filed: Aug. 5, 1993

[86] PCT No.: PCT/US93/07389

§ 371 Date: Dec. 16, 1994

§ 102(e) Date: Dec. 16, 1994

[87] PCT Pub. No.: WO94/03386

PCT Pub. Date: Feb. 17, 1994

[30] Foreign Application Priority Data

Aug. 6, 1992 [DE] Germany ..... 92 10 495 U

[51] Int. Cl.[6] ..... B65H 19/28; B65H 19/29

[52] U.S. Cl. ..... 242/530.4; 242/580

[58] Field of Search ..... 242/580, 530.4, 242/530, 532.3, 542.3, 533.2, 556, 556.1; 156/446, 187, 188, 193

[56] References Cited

U.S. PATENT DOCUMENTS

| | | | |
|---|---|---|---|
| 3,291,412 | 12/1966 | Rockstrom et al. . | |
| 3,553,055 | 1/1971 | Janik | 242/580 |
| 3,727,853 | 4/1973 | Kinoshita . | |
| 3,901,757 | 8/1975 | Eglinton | 156/446 |
| 3,912,571 | 10/1975 | Hartbauer et al. | 156/351 |
| 4,160,529 | 7/1979 | Hutzenlaub et al. | 242/530.4 |
| 4,351,687 | 9/1982 | Lesage | 242/580 |
| 4,550,882 | 11/1985 | Hutzenlaub et al. | 242/580 |
| 4,775,110 | 10/1988 | Welp et al. . | |
| 4,951,900 | 8/1990 | Goerner . | |
| 4,983,243 | 1/1991 | Nakano et al. | 156/192 |
| 4,988,052 | 1/1991 | Urban . | |
| 5,320,297 | 6/1994 | Goerner et al. . | |
| 5,356,087 | 10/1994 | Smith et al. | 242/525 |

FOREIGN PATENT DOCUMENTS

| | | | |
|---|---|---|---|
| 374872 | 6/1990 | European Pat. Off. | 242/580 |
| 0481929 | 4/1992 | European Pat. Off. . | |
| 2530596 | 1/1984 | France | 242/580 |
| 1801480 | 9/1970 | Germany . | |
| 1774850 | 6/1971 | Germany . | |
| 2510610 | 12/1975 | Germany . | |
| 3308271 | 9/1984 | Germany . | |
| 3611895 | 10/1987 | Germany . | |
| 3800702 | 8/1989 | Germany . | |
| 3800703 | 8/1989 | Germany . | |
| 3918023 | 4/1990 | Germany . | |
| 3027815 | 2/1991 | Japan | 242/580 |
| 3927209 | 2/1991 | Germany . | |
| 4039251 | 2/1992 | Japan | 242/580 |
| 3-259741 | 3/1993 | Japan . | |
| 5116819 | 5/1993 | Japan | 242/580 |
| 9118815 | 12/1991 | WIPO . | |

OTHER PUBLICATIONS

Research Disclosure, No. 249, Jan. 1985, Great Britain, pp. 77–79.

*Primary Examiner*—John M. Jillions

*Attorney, Agent, or Firm*—Dirk J. Veneman; Raymond W. Campbell; Gerald A. Mathews

[57] ABSTRACT

A winding machine for winding one or more traveling webs into a corresponding number of wound web rolls includes a backing roll for supporting the one or more traveling webs, a winding station for each traveling web, at least one such winding station disposed on each side of the backing roll, each winding station including a winding device for rotatably supporting a web roll as it is wound, and adhesive applicators mounted on a guide to travel longitudinally parallel with the axis of each roll being wound. The adhesive applicators are movable radially inwardly to a working position and outwardly to a stand-by position relative to the axis of rotation of the wound web roll so as to be retracted in the stand-by position when the last wrap of the web on the wound roll is made to attach the severed end of the web onto the finished wound web roll.

3 Claims, 2 Drawing Sheets

FIG. Ib
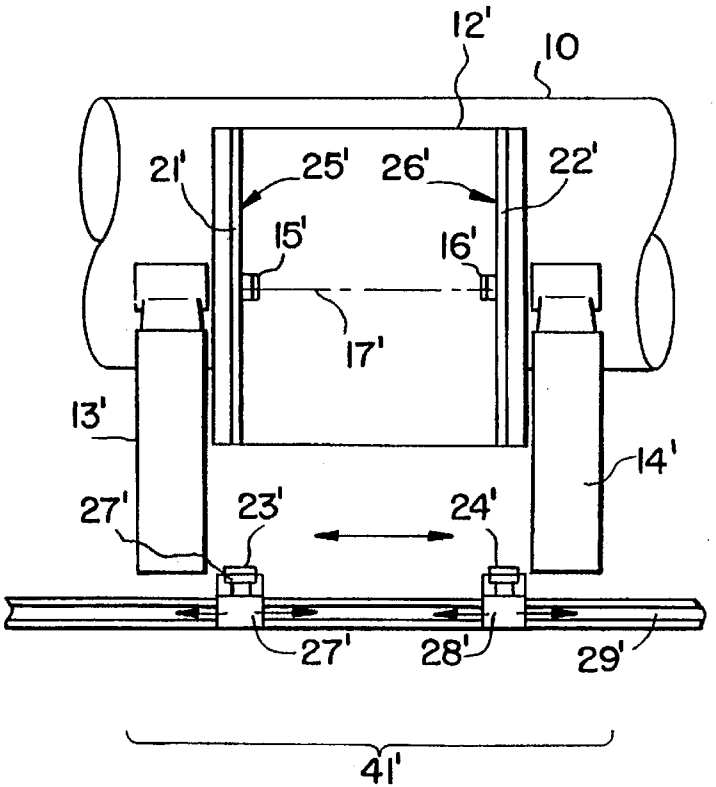
FIG. Ia
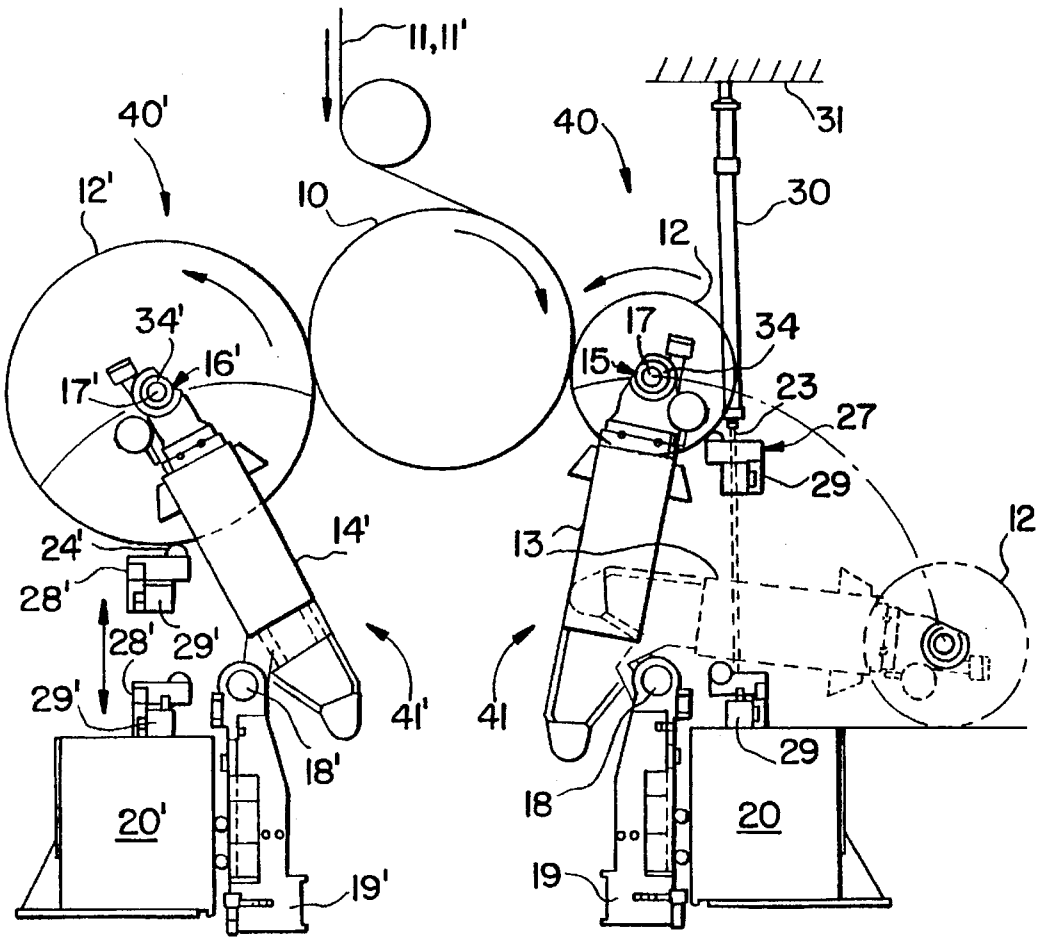

APPARATUS FOR APPLYING ADHESIVE TO A WEB ROLL BEING WOUND IN A WINDING MACHINE

TECHNICAL FIELD

This invention relates to the continuous formation of successive wound web rolls, such as paper, of a predetermined diameter from a traveling, substantially continuous web. More particularly, this invention relates to apparatus for applying an adhesive to an area of the web slightly downstream of where the web has been, or will be, severed to provide the length of web to produce the desired diameter of the wound web roll. Still more particularly, this invention relates to apparatus for automatically applying either a stripe of glue, or an adhesive tape, circumferentially about the peripheral surface of the wound web roll to attach the last wrap of the web about the finished wound roll. The apparatus for accomplishing this task operates without human intervention.

DESCRIPTION OF THE PRIOR ART

In prior machines for winding a traveling web into a finished wound roll, the trailing severed end of the web is typically attached to the wound roll by manually applying one or more spots of glue, or a length of adhesive tape which might be either two-sided, or one-sided, and applied either beneath the last layer of web or against the outer edge of the severed web. Applicators for applying either glue or tape manually in this manner are commercially available.

Each of these methods required a human operator to physically get close to the machinery to be exposed to the dangers inherent in being close to moving mechanical apparatus. The application of an adhesive to the wound roll to seal the finished wound roll necessarily involves undesirable variation in both the quantity of the adhesive applied, and the location of the adhesive, both of which detract from the desired uniformity and quality of the finished roll product.

It is also conceivable to use means, such as staples, which cling to the outer layers of the web and are pressed into the wound roll to secure the last web layer to the roll.

An advantage of this invention is that it provides apparatus for uniformly applying an adhesive to the web near the end of the winding of a finished wound roll (such as, for example, the second to last turn of the web) to adhere the trailing portion of the web to the wound web roll. All this can be accomplished without requiring a human to come close to the moving machinery and rotating wound web roll, and without requiring the roll being wound to be stopped to have the trailing web attached.

In a document identified as "2244 Research Disclosure", No. 249, Great Britain, January 1985, apparatus for applying an adhesive to film being wound into wound rolls is disclosed. This apparatus utilizes a pair of rotating rollers 2,2' between which the traveling web to be cut, and have an adhesive applied thereto, is passed. The apparatus utilizes a web-end tape holding mechanism 4, co-axially mounted relative to roller 2, into which a gluing tape 6 is inserted and held under the influence of suctioned air. A tape fixing auxiliary roller 7 is actuatable to cooperate with a belt-like tape feeder 5 to secure the tape onto holding mechanism 4 which rotates in conjunction with cooperating knives 3,3' to apply the tape to the severed end of the traveling film 1. The severed film then travels downstream where it is utilized to secure the end of the film to the wound web roll 9 by being nipped between a pressure roll 10 and the wound roll 9.

Such apparatus does not utilize positioning means or actuating means which operate to move adhesive attaching means to position the adhesive attaching means first parallel with the rotational axis of the web roll being wound, and then transversely toward and away from the web roll being wound.

IN THE DRAWINGS

FIG. 1*a* is an end-elevational view, in somewhat schematic form, of a web winding machine, and showing the adhesive applying apparatus.

FIG. 1*b* is a front-elevational view of the web winding machine, and showing the traversing arrangement for laterally guiding the working heads parallel to the rotational axis of the web roll being wound.

FIG. 2*a* is an end-elevational view of a web winding machine similar to that shown in FIG. 1*a*, but showing another embodiment of the adhesive applying apparatus.

FIG. 2*b* is a front-elevational view of the apparatus shown in FIG. 2*a*, and showing the working heads being applied to the web roll being wound by actuation apparatus.

DESCRIPTION OF THE PREFERRED EMBODIMENTS

Figure 2B:
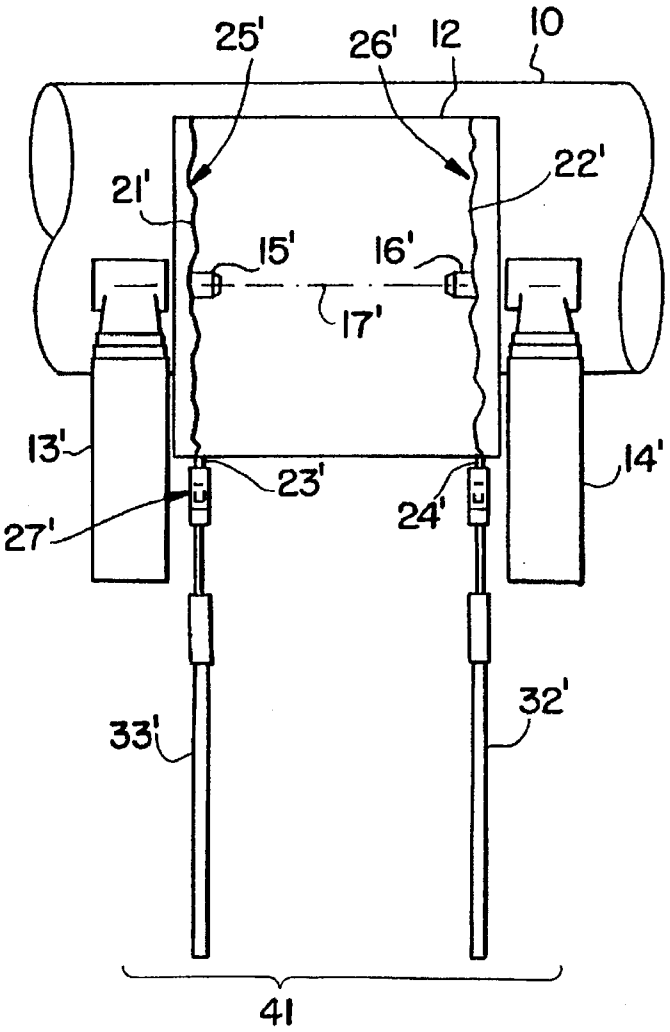

In the preferred use of this invention, a stripe of glue, or two-sided adhesive tape, is applied to the outer surface of the second to last turn of the web as the traveling web is being wound into a wound web roll. In this manner, the last turn of the web comes into contact with the stripe of glue or adhesive tape on its inner surface, but not on its outer surface. Preferably, the application of the adhesive application occurs along the entire circumference of the wound web roll to provide an uninterrupted line of adhesive attachment. However, it is also contemplated that a line of dots or dashes of adhesive could be applied along the circumference of the wound roll, as desired.

In a preferred embodiment, the adhesive attachment of the web to the wound web roll is provided along two, spaced, parallel lines extending about the circumference of the web roll. By locating these lines of adhesive close to the lateral edges of the web, the wrapped web can be stabilized to achieve a firm cover, and the application of the adhesive can be more easily coordinated with the support arms which support the core, or spool, on which the web is wound. Specifically, the adhesive applicators can be mounted to move laterally in the machine, or longitudinally relative to the wound roll, with the support arms.

The solution provided by the invention resides in the concept of positioning a working head for attaching the adhesive to the web, such as paper, being wound into the wound roll at a plurality of locations spaced axially along the length of the roll.

An especially elegant realization of this invention is a modular concept where the working heads are arranged on apparatus for automatically inserting cores into position to be received by support arms and to have webs wound into wound web rolls on the cores. This arrangement can be realized both where the core insertion is provided by a channel which is moved by a lifting/lowering, or pivoting, traverse device extending across the machine, or where the core insertion is provided by two lifting or pivoting arrangements per core to be wound into a web roll, movable together with the support arms for each core chuck.

This invention is particularly suited for use in conjunction with paper winders utilizing a central backing roll for supporting a plurality of axially aligned web rolls being wound which are arranged in two rows, substantially horizontally arrayed, about the periphery of the backing roll, about 180 degrees apart. This also permits the use of a so-called central drive on the backing roll. Also, in this so-called duplex winding arrangement utilizing a central backing roll, the web rolls being wound are each supported by a pair of spaced, parallel arms which are pivoted to move outwardly as the diameter of the wound roll increases. The ends of the support arms contain a core chuck which is inserted into the ends of a core, sometimes called a tube or reel spool, in such a manner as to permit the core to be driven when the core chuck is rotated to rotate the wound web roll. The core chuck is driven by a motor, such as a DC motor, which is mounted in the support arm on either side of the roll. Such a driving arrangement is known from DE 38 00 703 A1. In addition, by mounting the adhesive applicator to each pivoted support arm which has a powered core chuck mounted in it, the adhesive applicator can always be positioned at a desired distance inside the lateral edge of the web for each wound web roll and will also move radially outwardly with the core as the diameter of the wound web roll increases. This guarantees the maximum flexibility regarding the number and placement of the adhesive applicator locations to provide the circumferentially arrayed lines of adhesive in predetermined axial positions of the wound web roll.

In the following description of the preferred embodiments, corresponding elements will be designated with the same numeral, with a prime mark used to distinguish between like elements. It is understood that some elements located on the back side of the apparatus in a particular figure are hidden and, therefore, might not be shown.

Referring to FIGS. 1*a* and 1*b*, a traveling web, such as paper, has been longitudinally slit into two individual sub-webs 11,11' and are traveling in the direction of the arrow to be guided onto, and supported by, a backing roll 10 in a web winding machine, designated generally by numeral 100. One of the webs is supported over the backing roll surface for approximately 90 degrees and is guided onto a core, sometimes known as a tube or reel spool, and is being wrapped into a wound web roll 12. The other sub-web travels over substantially 270 degrees of the circumferential surface of the backing roll and is being wound into web roll 12'. Each of the wound web rolls 12,12' is being wound on a corresponding winding device 41,41'. In the event that there are more than two sub-webs 11,11', such as, for example, eight sub-webs, then there would be a corresponding plurality of winding devices 41, which are arranged laterally next to each other with an axial spacing and which are arranged to be shiftable in relation to the other winding devices 41. A plurality of longitudinally arrayed, laterally spaced rolls 12,12' in winding devices 41,41' comprise a winding station 40,40'.

The reel spool on which the wound web rolls 12,12' are wound is supported at either end by a core chuck 15,15' and 16,16' which, in turn, is mounted in a corresponding arm 13,14; 13',14' as shown in FIG. 2*b* to extend parallel with the rotational axis of the backing roll. Thus, a wound web roll 12,12' is held at its extremities by a corresponding core chuck mounted in a corresponding support arm 13,14 or 13',14'. The support arms are, in turn, pivotally mounted at 18,18' to supports in a manner well-known to those skilled in the art. The core chucks are each driven by a motor, which is preferably an air-cooled DC motor, which is mounted in each of the supporting arms co-axially. The motors are configured to engage, and rotate, the core chucks at right angles. The driven core chucks, thus, rotate the wound web roll about an axis 17,17', which is the longitudinal axis of the would roll. The driving arrangements are known from German document DE 38 00 703 A1.

The support arms 13,13' and 14,14' are pivotally mounted about axes 18,18'. The manner in which the support arms are pivoted under power is also known to those skilled in the art and, in view of this and for clarity, is not specifically shown and will not be described in detail. The support arms are, thus, capable of pivoting outwardly, while maintaining desired nip pressure, from the backing roll 10 as the diameters of the wound rolls 12,12' increase as the traveling webs are wound.

In order to accommodate the winding of webs having different widths, the pivoted axial mounting 18,18' of each pair of support arms 13,14,13',14', etc., are mounted on a sled, or carriage, 19,19', each of which is movable along support bases 20,20' of the winder 41,41' and which extend in the direction of the width of the machine, that is, parallel to the axis of the backing roll 10.

In order to apply a stripe of glue or two-sided adhesive tape to the outer circumference of the second-to-last turn of a web roll being wound, working heads 27,28 and 27',28' are provided. Each of these working heads supports an applicator 23,24 and 23',24', respectively, for the application of the selected adhesive to a circumferential path 25,26 or 25',26' on the surface of the wound web roll. The working heads are pressed resiliently (i.e. elastically) against the wound web roll to apply the adhesive. This guarantees the adhesive to be properly applied, even in the case where the traversing guide support, or traverse support, has deflected for any reason.

The working heads in FIGS. 1*a*, 1*b* are mounted to move, such as in sliding contact, in traversing guides 29,29' which extend transversely to the direction of web 11,11' travel, or parallel to the rotational axis of backing roll 10.

Figure 2A:
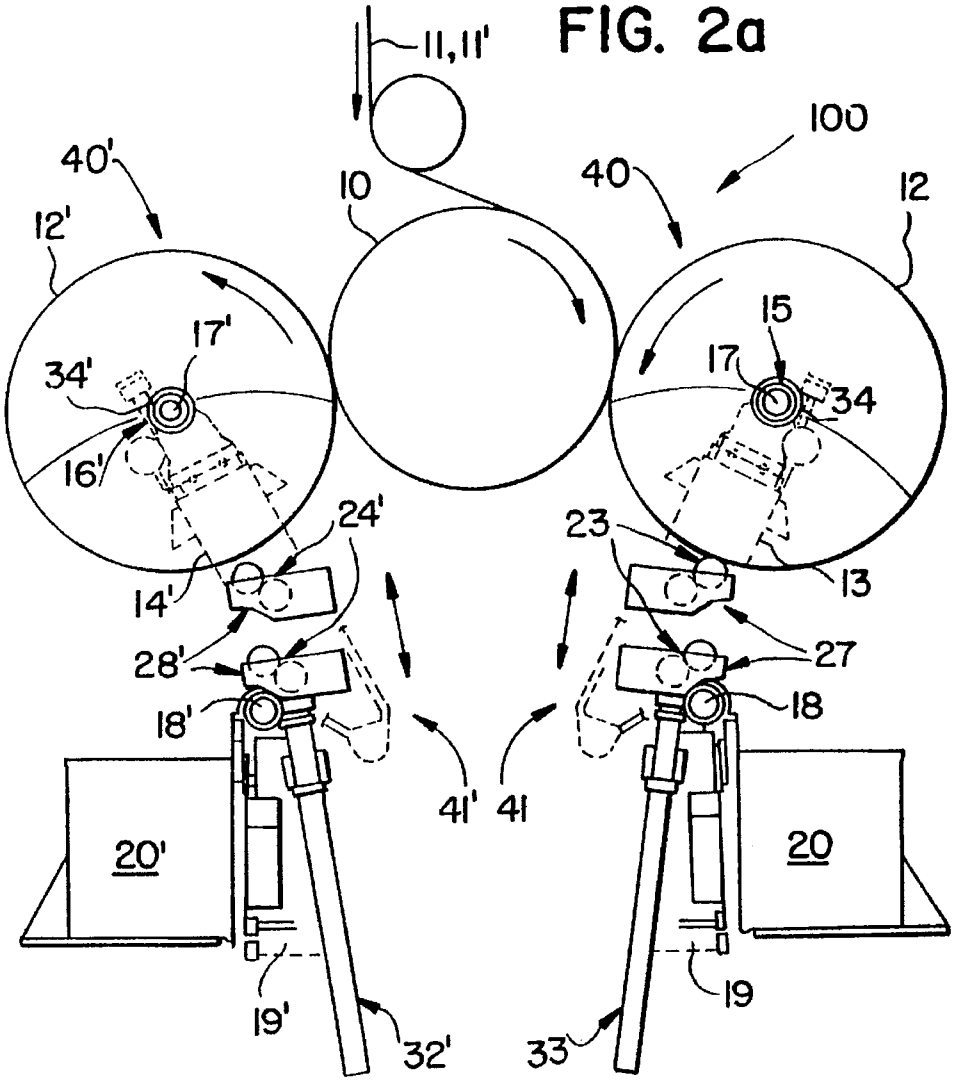

For purposes of illustration, the working heads 27,28' shown in FIG. 1*a* depict a tape cartridge applicator 23,24' for applying two-sided adhesive tape to the circumference of the wound paper roll, and the corresponding applicator shown in FIG. 2*a* represents a roller-applicator 23,24' for the application of a glue stripe to the circumference of the wound web roll.

With reference to both FIGS. 1*a*,1*b* and 2*a*, 2*b* the working heads 27,28 or 27',28' are brought from their stand-by positions, where they are transversely supported on carriages 19,19' (FIG. 2*a*) or by traversing guides 29,29' (FIG. 1*b*), into their working position, where they are in resilient contact with the outer circumference of the wound web rolls 12,12'. In the embodiment shown in FIG. 2*a*, the working heads are attached to the ends of power cylinders 32'33 which, in turn, are mounted on carriages 19,19' and can pivot about swivel axes 18,18'.

A lifting cylinder 30, which might comprise a hydraulic or pneumatic powered cylinder, or a powered (electrical) ball-type screw, or a screw jack, is provided for each end of the wound web roll in the embodiment shown in FIG. 1*a*. Only one such actuation cylinder 30 is shown in FIG. 1*a* for clarity. The actuation cylinder is mounted to the frame of winder 100 and extends downwardly to engage a working head and retract to resiliently bring the adhesive applicator on the working head into a working position against the wound web roll. It then returns the working head to its stand-by position in the traversing guide. The working heads can be mounted to traverse with the support arms. The traverse guide 29,29' is, in turn, mounted for support on supports 20,20', respectively. An independent drive, such as an electrical motor connected to a looped chain by a drive sprocket, can be connected to the working heads 27',28', either individually per head, or per pair of working heads, as desired. Such a drive arrangement is within the skill of those in the art, so it is not shown and will not be described further.

If desired, the transverse distance, or spacing, of the working heads can be fixed, in which case they could be moved together as a unit by the traversing drive. The fixed distance could correspond to the web width.

To move the working heads into working position against the wound web rolls, the entire traverse guide 29,29' can be moved transversely upwardly, in the direction of the double-headed arrow shown in FIG. 1*a*, to apply the adhesive to the wound roll. Since the adhesive applicator 23',24' held in the working head is stationary, and since the rolls 12,12' are rotating in their respective support arms, the adhesive is applied along circumferentially extending paths 25',26', as shown in FIG. 1*b*. When the adhesive has been applied to the circumference of the wound web roll, the powered cylinder 30 is deactivated to return the working heads to their stand-by position, which is represented as the lower position in FIGS. 1*a* and 2*a*. There, the working heads are supported in the traverse guides 29,29' (FIG. 1*b*) or on the ends of power cylinders 33',32' (FIG. 2*a*). Since the working heads can move longitudinally along the length of the traverse guides parallel to the rotational axes of the wound web rolls, and since the actuators (i.e. powered cylinders 30) operate at right angles to the reciprocating directions of movement of the working heads, as shown by the double-headed arrows associated with working heads 27',28' in FIG. 1*b*, the working heads can be positioned to accommodate any width of web being wound into a roll to apply a circumferential path of adhesive onto the web roll. The illustration of the powered cylinder 30 in FIG. 1*a* shows that the distance of the stroke to move the working head/adhesive applicator from the stand-by position to the working position can vary, depending on the desired diameter of the wound web roll.

Referring now to FIG. 1*b*, the working heads 27',28' have been moved into such a position on the traverse guide 29' that they become effectively close to the lateral edges of the wound web roll 12' to produce adhesive along circumferentially extending paths 25',26' which are parallel and close to the ends of the wound web roll.

The embodiment shown in FIGS. 2*a*, 2*b* is similar to that shown in FIGS. 1*a*, 1*b*, except that the means for mounting and actuating the working heads is somewhat different. Thus, in FIG. 2*b*, the circumferentially extending lines of glue 21,22,21',22' are applied by working heads which are attached directly to actuators 32',33". These actuators, like the actuator 30 shown in FIG. 1*a*, can comprise a hydraulic or pneumatic powered cylinder, or an electric powered ball-type screw, or similar linear motion power device. These actuators 32',33' can also serve a second function as tube/reel spool 34,34' loaders for moving fresh tubes, or reel spools, into their working position from a storage position in a channel beneath the backing roll 10. Reference is made to WO 91/18815 and DE 38 08 271 A1. The feeding of fresh cores upwardly into their operating position where they are supported by the core chucks is known to those skilled in the art and, therefore, is not shown in detail and will not be described further.

The traversing movement of the actuators 32',33' on which the working heads 27",28' are mounted is accomplished by moving the carriages 19,19', on which the axes 18,18' are pivotably supporting the support arms and on which the actuators are also mounted so as to move with the support arms, laterally across the apparatus parallel to the rotational axis of backing roll 10. The power actuators 32,33,32',33' are permanently mounted to their respective carriages, or sleds, 19,19'.

Accordingly, in both embodiments, the working heads can be mounted to traverse with a corresponding support arm to apply the adhesive to a wound web roll uniformly relative to an edge of the roll.

What is claimed is:

1. A web winding machine for winding one or mere traveling webs (11,11') into a corresponding number of wound web rolls (12,12'), including a backing roll (10) for supporting the one or more traveling webs and the one or more wound web rolls over its surface with the rotational axes of the rolls (10,12,12') parallel, and at least one winding station (40,40') including at least one winding device (41, 41') for rotatably supporting the at least one wound web roll (12,12'), wherein the improvement comprises:

adhesive attaching means (23,23',24,24') mounted proximate the said one or more wound web rolls for attaching an adhesive to a portion of each of the one or more traveling webs, the adhesive attaching means including one or more working heads (27,27', 28,28') for supplying the adhesive:

positioning means (19,19',29,29') for movably positioning the working heads longitudinally relative to the rotational axes of the wound web rolls, and parallel with the rotational axes of the said one or more wound web rolls;

actuating means (30,32,32',33,33') for engaging and reciprocally moving the working heads from the positioning means translationally relative to the rotational axes of the one or more wound web rolls to apply the adhesive to the selected portion of the web on the one or more wound web rolls the at least one web winding station (40,40') includes support arms (13,14,13',14'), a core supporting device (15,16,15',16') for rotatably supporting and rotating a web roll wound on the core, characterized in that:

a working head (27,27',28,28') is operatively associated with a respective one of the corresponding actuating means (32,33,32',33') for moving a corresponding working head translationally relative to the axis (17,17') of the web roll being wound from a stand-by position remote from the wound web roll to a working position against the wound web roll;

the said support arm means (13,14,13',14') for rotatably supporting each wound web roll, being so constructed and arranged as to be moveable with the actuation means (32,33,32',33') parallel with web roll axes (17,17').

2. A web winding machine for winding one or more traveling webs (11,11') into a corresponding number of wound web rolls (12,12'), including a backing roll (10) for supporting the one or more traveling webs and the one or more wound web rolls over its surface with the rotational axes of the rolls (10,12,12') parallel, and at least one winding station (40,40') including at least one winding device (41, 41') for rotatably supporting the at least one wound web roll (12,12').

wherein the improvement comprises:

adhesive attaching means (23,23',24,24') mounted proximate the said one or more wound web rolls for attaching an adhesive to a portion of each of the one or more traveling webs, the adhesive attaching means including one or more working heads (27,27', 28,28') for supplying the adhesive; positioning means (19,19',29,29') for movably positioning the working heads longitudinally relative to the rotational axes of the wound web rolls, and parallel with the rotational axes of the said one or more wound web rolls, the positioning means includes traverse guide means (29,29') which extend for substantially the width of the machine, parallel to the rotational axes of the wound web rolls (12,12');

the working heads (27,28,27',28') are mounted in the traverse guide means;

actuating means (30,32,32',33,33') for engaging and reciprocally moving the working heads from the positioning means translationally relative to the rotational axes of the one or more wound web rolls to apply the adhesive to the selected portion of the web on the one or more wound web rolls, at least one actuation device (30) for selectively engaging and bringing the traverse guide means into working position for the working heads to apply adhesive to the web and for returning the traverse guide means and working heads into a stand-by position.

3. A web winding machine for winding one or more traveling webs (11,11') into a corresponding number of wound web rolls (12,12'), including a backing roll (10) for supporting the one or more traveling webs and the one or more wound web rolls over its surface with the rotational axes of the rolls (10,12,12') parallel, and at least one winding station (40,40') including at least one winding device (41, 41') for rotatably supporting the at least one wound web roll (12,12'), wherein the improvement comprises;

adhesive attaching means (23,23',24,24') mounted proximate the said one or more wound web rolls for attaching an adhesive to a portion of each of the one or more traveling webs, the adhesive attaching means including one or more working heads (27,27', 28,28') for supplying the adhesive, the working heads (27,27',28,28') are mounted in the at least one winding device (41,41') for inserting fresh cores (34,34') into their respective winding position for receiving the traveling web to be wound onto the core;

positioning means (19,19',29,29') for movably positioning the working heads longitudinally relative to the rotational axes of the wound web rolls, and parallel with the rotational axes of the said one or more wound web rolls;

actuating means (30,32,32',33,33') for engaging and reciprocally moving the working heads from the positioning means translationally relative to the rotational axes of the one or more wound web rolls to apply the adhesive to the selected portion of the web on the one or more wound web rolls, the actuating means (32,32',33,33') are operatively associated with a support (20,20') for actuating selected ones of said working heads to move the working heads substantially radially toward the web roll being wound to apply the adhesive to a selected portion of the peripheral surface thereof.

* * * * *